US008241134B2

(12) United States Patent
Flood, Jr.

(10) Patent No.: US 8,241,134 B2
(45) Date of Patent: Aug. 14, 2012

(54) COMPONENTS FOR EXTREME SPORTS COURSES

(75) Inventor: Robert Flood, Jr., Marquette, MI (US)

(73) Assignee: Railyard, L.L.C., Gwinn, MI (US)

( * ) Notice: Subject to any disclaimer, the term of this patent is extended or adjusted under 35 U.S.C. 154(b) by 204 days.

(21) Appl. No.: 12/759,774

(22) Filed: Apr. 14, 2010

(65) Prior Publication Data

US 2011/0059807 A1 Mar. 10, 2011

Related U.S. Application Data

(60) Provisional application No. 61/276,264, filed on Sep. 10, 2009.

(51) Int. Cl.
*A63C 19/02* (2006.01)
*A63C 19/00* (2006.01)

(52) U.S. Cl. ..... 472/88; 472/89; 256/1

(58) Field of Classification Search ..... 472/88–91, 472/136; 404/6, 7; 256/1, 13.1
See application file for complete search history.

(56) References Cited

U.S. PATENT DOCUMENTS

| | | | | |
|---|---|---|---|---|
| 5,010,702 | A | 4/1991 | Daw et al. | |
| 5,820,470 | A | 10/1998 | Saunders | |
| 6,190,085 | B1 * | 2/2001 | Johansson | 404/6 |
| 6,672,968 | B2 | 1/2004 | Montolio | |
| 7,311,464 | B2 | 12/2007 | Swartz | |
| 2004/0200015 | A1 | 10/2004 | Rieber et al. | |
| 2005/0000042 | A1 | 1/2005 | Marko et al. | |
| 2007/0062131 | A1 | 3/2007 | Yokubison et al. | |

OTHER PUBLICATIONS

International Search report for PCT/US 10/45152 (dated Dec. 6, 2010).

* cited by examiner

*Primary Examiner* — Kien Nguyen
(74) *Attorney, Agent, or Firm* — Wood, Phillips, Katz, Clark & Mortimer

(57) ABSTRACT

An extreme sports component having a support and at least a first member defining a maneuvering surface. The support and at least first member are operatively joined through at least one member on each of the support and at least first member that cooperate with each other so as to maintain the support and at least first member in a predetermined operative relationship. The support and at least first member are maintained in the predetermined operative relationship without requiring that any anchoring element be directed through the maneuvering surface.

26 Claims, 19 Drawing Sheets

COMPONENTS FOR EXTREME SPORTS COURSES

BACKGROUND OF THE INVENTION

1. Field of the Invention

This invention relates to extreme sports, such as skateboarding, snowboarding and wakeboarding and, more particularly, to components through which users can perform maneuvers on courses for these activities.

2. Background Art

Extreme sports are becoming increasingly popular worldwide. Within this sports category are skateboarding, snowboarding, wakeboarding, etc. These activities are performed on courses ranging from backyard setups to extensive and expensive indoor and outdoor facilities devoted to these activities, including those at which competitive events are staged.

On these courses, a multitude of different components are placed to facilitate different maneuvers by the users thereof. Among these, but not inclusive of these components, are ramps, rails, boxes, walls, decks, etc. These components typically will have upwardly facing "grind", or maneuvering, surfaces that are acted against by wheels and/or boards on the user's equipment as the user travels thereover and/or performs maneuvers thereupon.

Commonly the upper maneuvering surfaces are defined by non-metal sheets or layers that are affixed, at least temporarily, to an underlying support, that is in turn borne by a subjacent surface. The supports generally have a frame that defines a region that is at least nominally matched to the desired maneuvering surface configuration. One or more separate sheets or layers are applied to the frame region and secured thereto in a manner whereby they might be replaced, as when they become worn.

In one form, the maneuvering surfaces are defined by sheet layers that are applied to the support and maintained in operative position thereagainst using threaded fasteners. The fasteners are directed into bores extending through the maneuvering surface, the sheet layer, and into the underlying support frame. The fastener heads are preferably flush with the maneuvering surface, and more preferably recessed therebelow, so as not to interfere with the movement of the user's board and/or wheels thereagainst.

While this method of securing the layers has been widely used and is for the most part practical, it has a number of inherent drawbacks. First of all, the bores through the maneuvering surface, regardless of the nature of the fasteners used and their manner of insertion, create localized interruptions of the maneuvering surface. This could affect movement of wheels/boards against the maneuvering surface. Additionally, these bores create locations at which cracks are prone to developing. This is a problem with non-metal materials that may be used in direct sunlight and thus may be heated to elevated temperatures. This problem may be even more significant with the equipment used in colder temperatures, wherein the maneuvering surface may be less flexible and prone to cracking upon impact. The bores produce localized stress concentration areas at which cracks may develop.

Aside from the bores themselves creating potential problems, these problems may be aggravated by the manner in which the fasteners are tightened. Different degrees of tightening may produce localized areas of depression or elevation that undesirably alter the contour of the maneuvering surface.

Vertically inserted fasteners are also prone to separating from the underlying support as they are subjected to different forces in use. For example, a wheel traveling over a fastener location may temporarily compress the material underlying the fastener head. Upon release of this force, there may be a force applied to the fastener that causes it to either loosen through a turning action or become partially or fully stripped after repeated impact forces are applied. This condition may cause loosening of the sheet from the underlying support, whereupon it may be prone to shifting.

The fasteners may also release to the point that they project upwardly from the maneuvering surface, whereupon they may be contacted by a user and/or his/her board during use. During competitions, this condition may alter the operating characteristics of the components from one competitor to the next. These conditions are also potentially dangerous to users as the fasteners could contact the user during use and/or divert the path of movement of his/her board.

Consequently, the conventional construction has required a great degree of monitoring by those responsible for maintaining the course components. Aside from the inconvenience and potential expense associated with such monitoring, it is inevitable that lapses in oversight of facilities will allow such conditions to develop and persist.

Still further, the use of vertically directed fasteners may allow buckling to occur for the layers, as in extreme temperature environments. This condition may result in different surface characteristics from one point in time to the next and, in a worst case, may create a dangerous condition that could lead to an injury.

Certain of the above components, such as rails, commonly employ upright supports to maintain the maneuvering surface elevated to a desired degree above a subjacent surface. Commonly, these upright supports are made variable in length by using telescopingly engaged components that can be fixed in different relative lengthwise positions to produce different overall vertical lengths. Most commonly, round or matched polygonal shapes are provided for the cooperating components. As one example, square tubular stock is often utilized with a male component having flat sides dimensioned to fit slidingly within a correspondingly configured female component.

In designing these components, the inside dimensions of the female component and outside dimensions of the male component are selected so that these components can slide guidingly relative to each other in a lengthwise direction without substantial interference. At the same time, it is desired that there be limited play between these components so that they are not allowed to turn relative to each other around their lengthwise axes. In certain respects, these objectives compete with each other. That is, to facilitate adjustment, a substantial gap may be established between the components that allows them to freely guidingly move relative to each other. This same gap may produce a substantial amount of play that allows an unwanted degree of movement of the structure supported thereon. This movement may affect the stability of the maneuvering surface, which has obvious detrimental consequences.

Additionally, the construction of the above type of vertical supports requires that the manufacturer maintain separate supplies of different stock that is used to form the male and female components.

The industry has contended with the above problems since there has been lacking structure that addresses the noted problems, is practical on a commercial level, and offers a viable alternative to conventional designs. The industry continues to seek out designs that are safe, operate consistently in all environmental conditions, and are appropriate for those involved from recreational to competitive levels.

SUMMARY OF THE INVENTION

In one form, the invention is directed to an extreme sports component including: a support; and at least a first member defining a maneuvering surface and joined operatively to the support. The support and at least first member are operatively joined through at least one elongate member on one of the support and at least first member and a slot for receiving the one elongate member on the other of the support and at least first member. The one elongate member is engageable within the slot so that the one elongate member is keyed against movement within the slot in directions other than along a first line.

In one form, the at least first member and support are joined from a separated position by aligning the at least one elongate member and slot and relatively moving the at least first member and support along the first line.

In one form, the extreme sports component further includes at least one anchor that does not extend through the maneuvering surface and blocks the at least first member against movement relative to the support along the first line.

In one form, the slot is part of the support that is made through an extrusion forming process.

In one form, the slot is part of the at least first member that is made through an extrusion forming process.

In one form, the at least one anchor extends into the slot and the one elongate member.

In one form, the at least one anchor extends into the slot and to against the at least one elongate member.

In one form, the at least one elongate member has an end and the at least one anchor defines a blocking surface that abuts to the end of the at least one elongate member to limit movement of the at least first member relative to the support along the first line.

In one form, the support has an edge and the at least first member wraps around the support edge.

In one form, the support has laterally spaced first and second edges spaced transversely to the first line and the at least first member has a thickness that is locally thickened adjacent the first support edge.

In one form, the support has laterally spaced first and second edges spaced transversely to the first line and the support has a portion that projects upwardly to define a grind surface at or above the first edge.

In one form, the maneuvering surface is made from a non-metal material.

In one form, the maneuvering surface is made from at least one of UHMW plastic, HPDE plastic, PVC plastic, a polymer or a polymer composite.

In one form, the support has laterally spaced first and second edges spaced transversely to the first line and the at least first member defines a receptacle for a grind member that defines a grind surface at or above the maneuvering surface.

In one form, the grind surface has a convexly curved shape.

In one form, the grind member has an elongate tubular configuration.

In one form, the receptacle and grind member are relatively configured so that the grind member can be one of snap fit or slide fit into and releasably maintained in the receptacle.

In one form, the at least first member has an inverted "U" shape as viewed in cross section taken transversely to the first line with a base and spaced first and second legs. The base defines the maneuvering surface and the first leg defines the one elongate member.

In one form, at least a part of the maneuvering surface resides in a plane. The support defines the slot and the slot opens in a line that is at a non-orthogonal angle with respect to the plane of the maneuvering surface.

In one form, the extreme sports component is provided in combination with at least a second member defining a maneuvering surface that has a different configuration than the maneuvering surface defined by the at least first member. The at least first and second members are releasably operatively joined, one in place of the other, to the support to allow a user to select a desired maneuvering surface configuration.

The invention is further directed to an extreme sports component including: a support; and at least a first member defining a maneuvering surface. The support and at least first member are operatively joined through at least one member on each of the support and at least first member that cooperate with each other so as to maintain the support and at least first member in a predetermined operative relationship. The support and at least first member are maintained in the predetermined operative relationship without requiring that any anchoring element be directed through the maneuvering surface.

DETAILED DESCRIPTION OF THE PREFERRED EMBODIMENT

Figure 1:
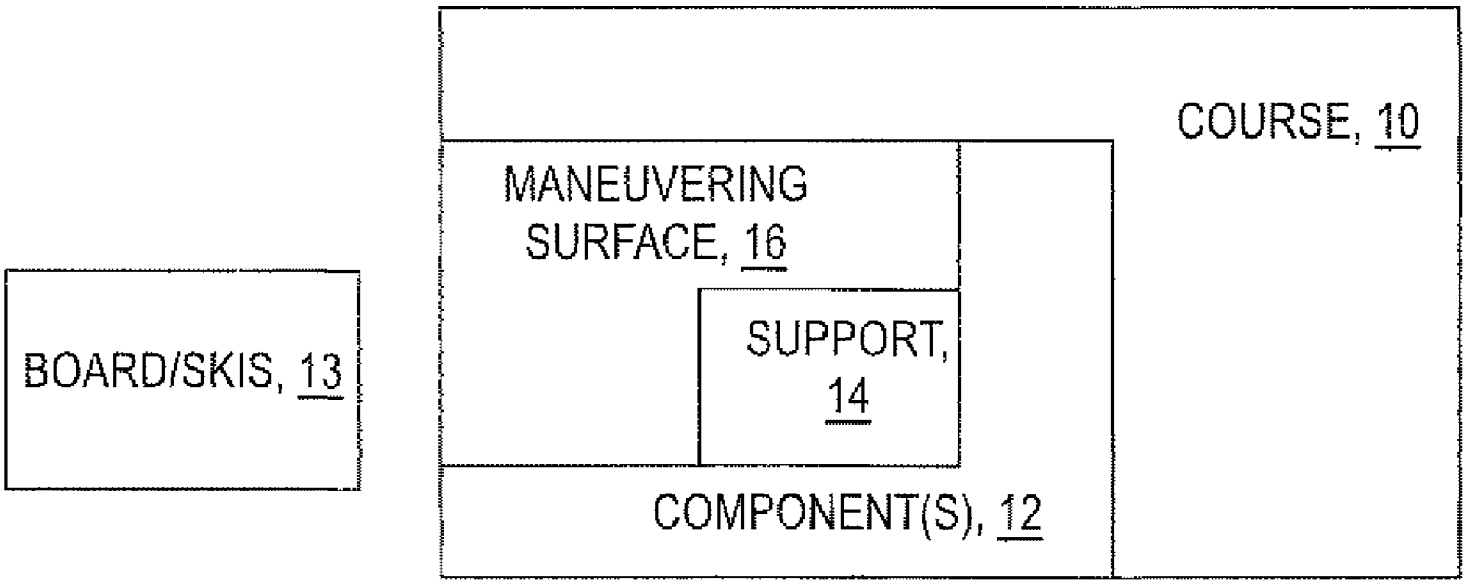
FIG. 1 is a schematic representation of a component on an extreme sports course and including a support for a member defining a maneuvering surface.

In FIG. 1, an extreme sports course is shown at 10, in schematic form. The course 10 is one typically used for skateboarding, snowboarding, snow skiing, or wakeboarding. The course 10 has at least one component 12 upon which any of a multitude of different activities might be performed using a board and/or skis 13. The component 12 consists of a support 14 through which at least one member defining a maneuvering surface 16 is maintained in a desired shape and in an operative position relative to a subjacent surface. The precise shape of the maneuvering surface 16 is not critical to the present invention and virtually every conceivable shape thereof might be utilized with the inventive concepts herein. The course 10 is shown schematically since it is intended through this depiction to encompass virtually an unlimited number of course layouts with different component configurations, that may be in the form of ramps, rails, boxes, walls, decks, etc., that are typically used for recreational and competitive extreme sports activities. The schematic depiction is intended to encompass all variations of the component(s) 12, with those described specifically hereinbelow being representative in nature only.

Figure 2:
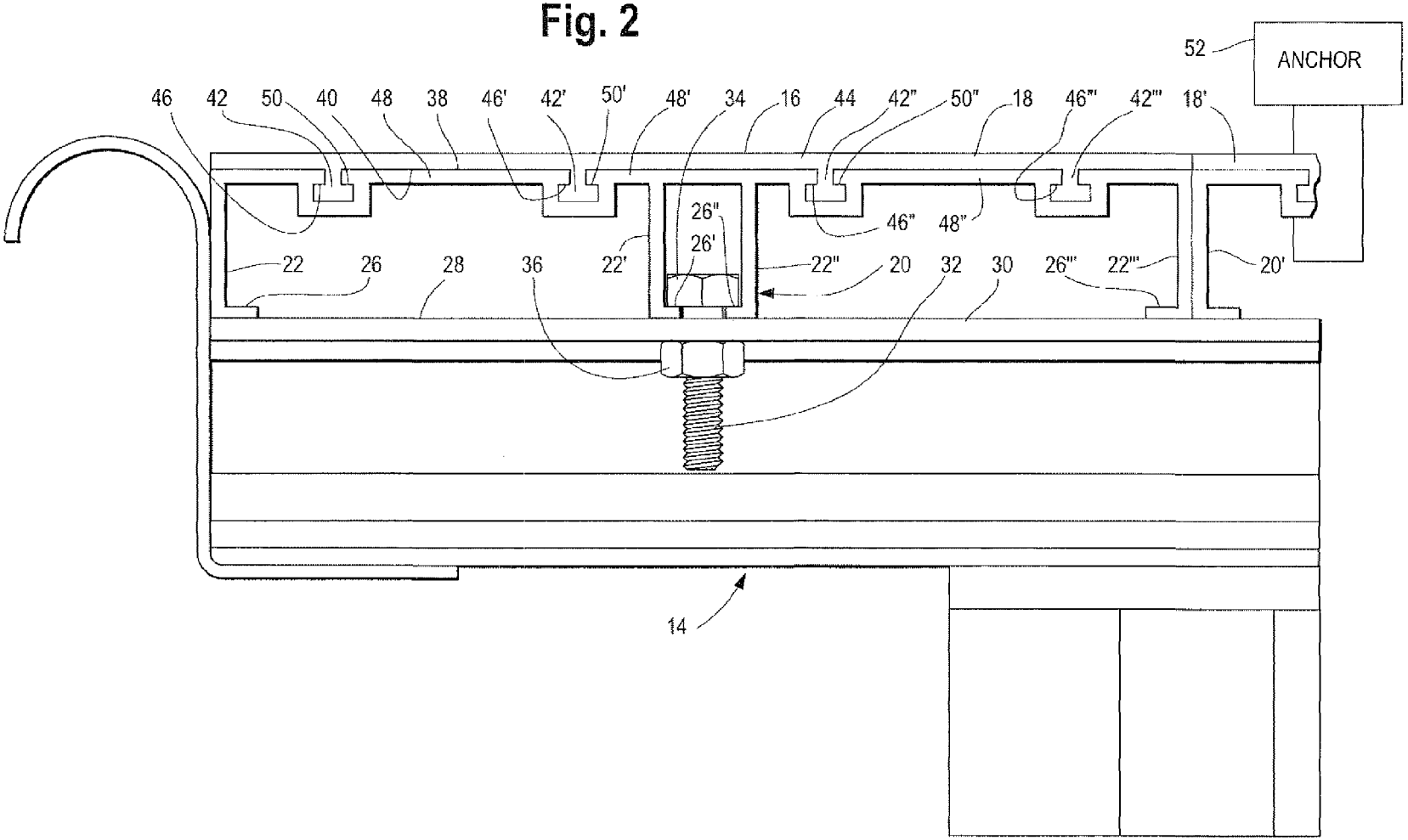
FIG. 2 is a fragmentary, elevation view of one specific form of the schematically depicted support and cooperating member defining the maneuvering surface in FIG. 1.
Figure 3:
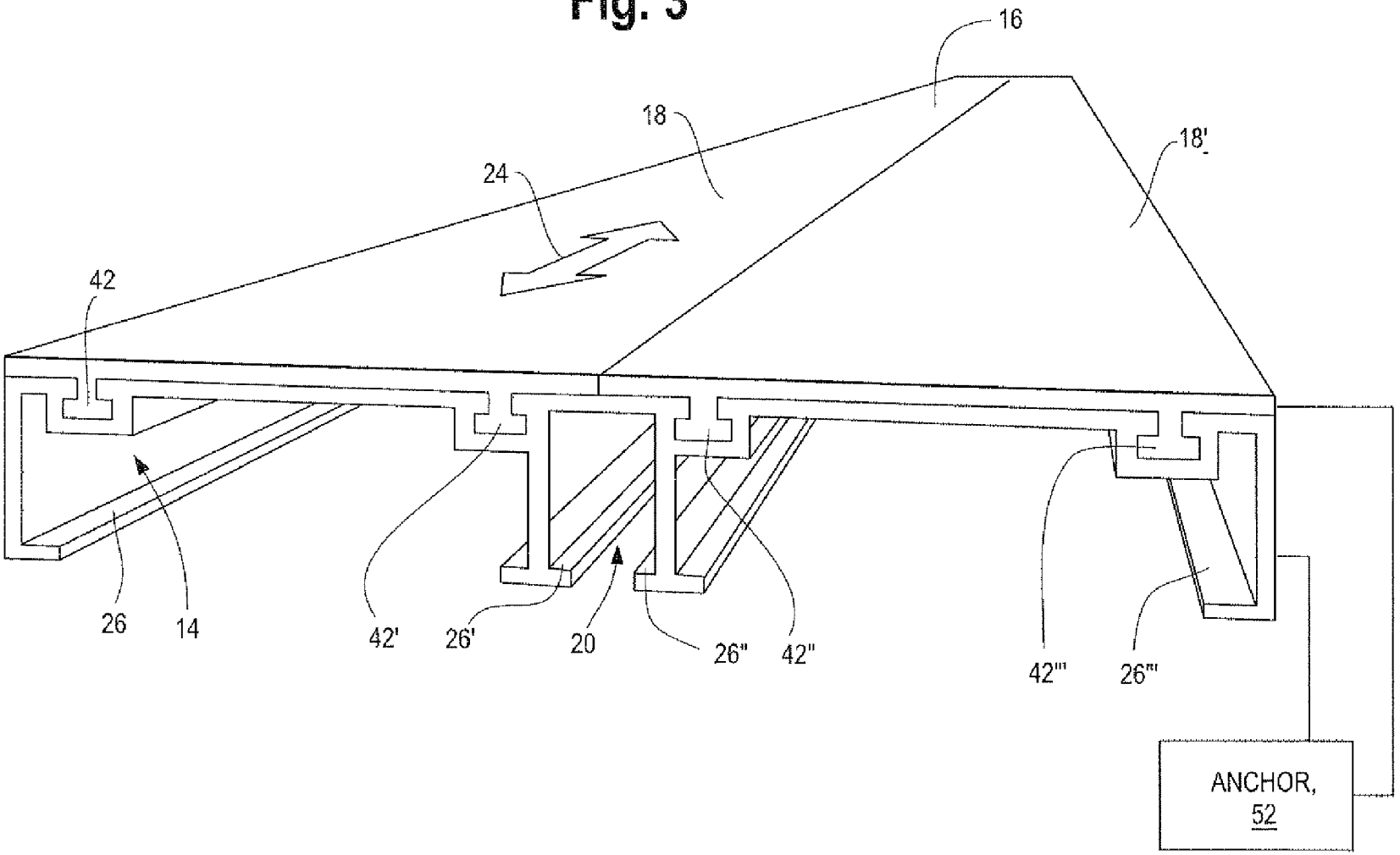
FIG. 3 is a perspective view of a frame element on the support with the member defining the maneuvering surface thereon.

In FIGS. 2 and 3, one specific form of the support 14 is shown. The support 14 consists of multiple joined parts that cooperatively maintain at least one, and as depicted plural, members 18, 18' operatively joined to the support 14 wherein the members 18, 18' cooperatively define the maneuvering surface 16.

The portion of the support 14 directly bearing the overlying member 18 consists of an extruded frame element 20 defining support legs 22, 22', 22", 22'" each with an elongate shape extending along a lengthwise line indicated by the double-headed arrow 24. The legs 22, 22', 22", 22'" have offset ends 26, 26', 26", 26'" that cooperatively bear upon an upper surface 28 of a flange 30 on another part of the support 14.

Bolts 32 are directed through the flange 30 to secure the frame element 20 to the support 14. A head 34 on each bolt 32 spans the offset ends 26', 26". With each bolt 32 extended through the flange 30 and a nut 36 threadably tightened thereon, the offset ends 26, 26" and flange 30 become sandwiched between, and captively held by, the head 34 and nut 36. The bolts 32 and nuts 36 can be provided at regularly spaced intervals, as appropriate, to securely affix the extruded frame element 20 to the flange 30.

The extruded frame element 20 defines an upper surface 38 against which the member 18 is placed. The member 18 is shown in the form of an extruded sheet with a flat surface 40, facing oppositely to the maneuvering surface 16, that facially abuts the surface 38 defined by the extruded frame element 20.

The support 14 and member 18 are operatively joined through cooperating elongate members, on one of the extruded element 20 and support 14, that are received in elongate slots on the other of the support 14 and member 18. The lengths of the elongate members and slots are aligned in substantially parallel relationship. In this embodiment, there are elongate members and slots defined on each of the support 14 and member 18, as described hereinbelow.

The member 18 has a plurality of inverted, T-shaped elements 42, 42', 42", 42'" formed integrally with a body 44 and depending therefrom. The elements 42, 42', 42", 42'" extend lengthwise substantially fully over the lengthwise extent of the ember member 18 along the line indicated by the arrow 24. This is not a requirement, however, so long as there is a significant lengthwise extent to key the member 18 against lateral shifting and guide lengthwise movement between the member 18 and support 14.

Each "T" is situated to align with a complementary slot 46, 46', 46", 46'" whereby the elements 42, 42', 42", 42'" can be directed into the slots 46, 46', 46", 46'" by aligning the elements 42, 42', 42", 42'", one each with the slots 46, 46', 46", 46'" with the member 18 initially separated from the support 14, and sliding the member 18 relative to the extruded frame element 20 along the line indicated by the arrow 24.

The extruded frame element 20 defines generally T-shaped elements 48, 48', 48" that respectively move within slots 50, 50', 50", respectively defined cooperatively by the elements 42, 42'; 42', 42"; and 42", 42'" and the portions of the body 44 connecting therebetween.

Through this arrangement, each of the elongate elements 42, 42', 42", 42'", 48, 48', 48" is keyed within its respective slot against movement in directions other than along the line indicated by the double-headed arrow 24.

As an alternative to the sliding connection of the frame element 20 and member 18, the member 18 could be aligned in its lengthwise operative position over the frame element and pressed downwardly to be snap fit to the frame element 20. This is permitted by making the elements 42, 42', 42", 42'" deformable yet sufficiently shape-retentive that they will spring back towards an undeformed state within their respective slots 46, 46', 46", 46'", to thereafter function as otherwise described herein.

At least one anchor 52 fixes/blocks the operatively joined member 18 against movement relative to the support 14 along the line indicated by the arrow 24. The nature of the anchor 52 can vary considerably, with it preferred that the anchor 52 does not extend through the maneuvering surface 16.

In one form, the anchor 52 extends into at least one of the elements 42, 42', 42", 42'", 48, 48', 48'" and its associated slot. As just one example, the anchor 52 might be an elongate post, threaded or unthreaded, that is directed generally horizontally into one of the elements 42, 42', 42", 42'", 48, 48', 48" and its associated slot. Alternatively, the anchor 52 might be vertically or angularly directed into the support 14 and member 18, at one or more locations, without penetrating the surface.

With the depicted interaction between the support 14 and member 18, it is possible to make the fit snug enough that no separate anchor is required to maintain the connection. Alternatively, the anchor 52 might be in the form of a simple lengthwise blocking arrangement, as at one or both lengthwise ends, or at an intermediate lengthwise location.

Figure 11:
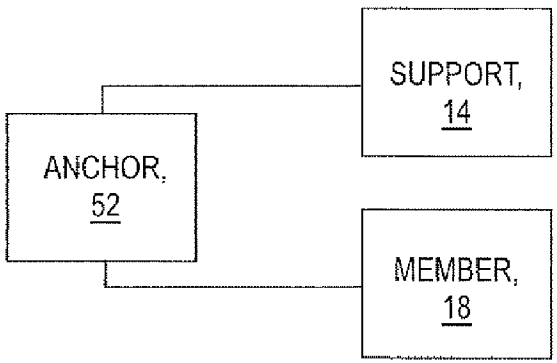
FIG. 11 is a schematic representation of an extreme sports component, according to the present invention, and including a support, a member defining a maneuvering surface, and an anchor for preventing separation of the member and support.

The schematic showing of the anchor 52' in FIG. 11 is intended to encompass all these variations and other anchor designs acting between the support 14 and member 18, some of which will be described in greater detail hereinbelow. It should also be understood that with the support 14 and member 18 operatively joined, one or more anchors might extend through the surface 18, although this is not preferred.

In this embodiment, the member 18 is formed so that the body 44 and elements 42, 42', 42", 42'" are extruded as one piece, preferably from a material such as polyethylene. Materials commonly employed in this application are UHMW plastic, HPDE plastic, PVC plastic, a polymer, or a polymer composite. Other suitable materials are well known to those in this field.

The member 18' may have the same configuration as the member 18 and cooperates with a similarly configured, extruded frame element 20' in the same manner that the member 18 cooperates with the frame element 20.

Figure 4:
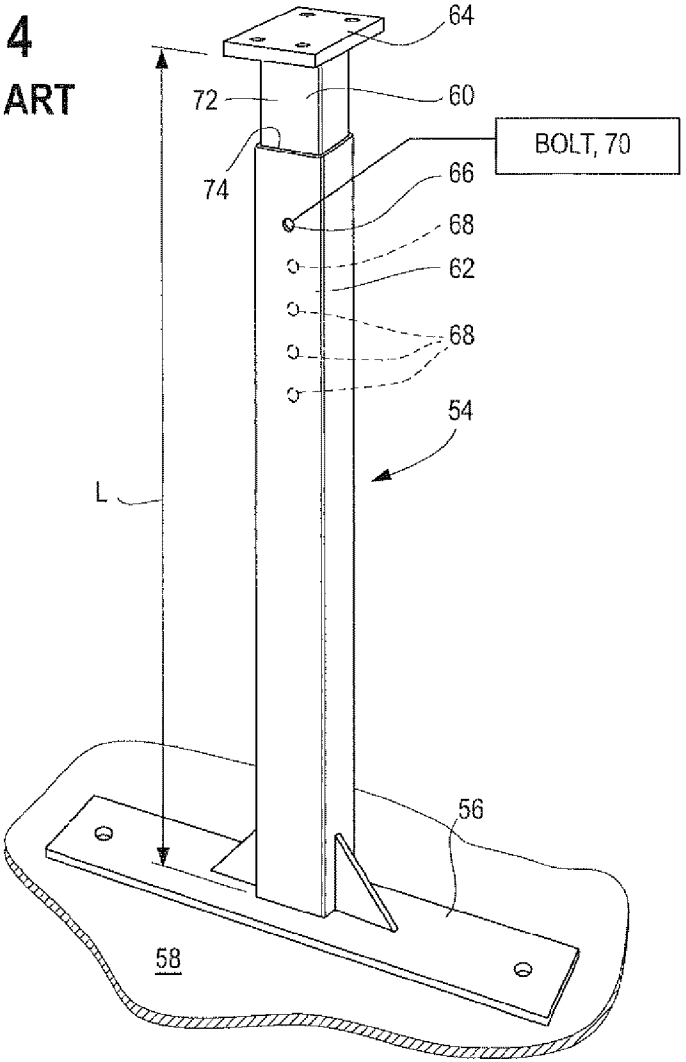
Fig. 4 PRIOR ART
FIG. 4 is a perspective view of a conventional support assembly for a member defining a maneuvering surface.
Figure 5:
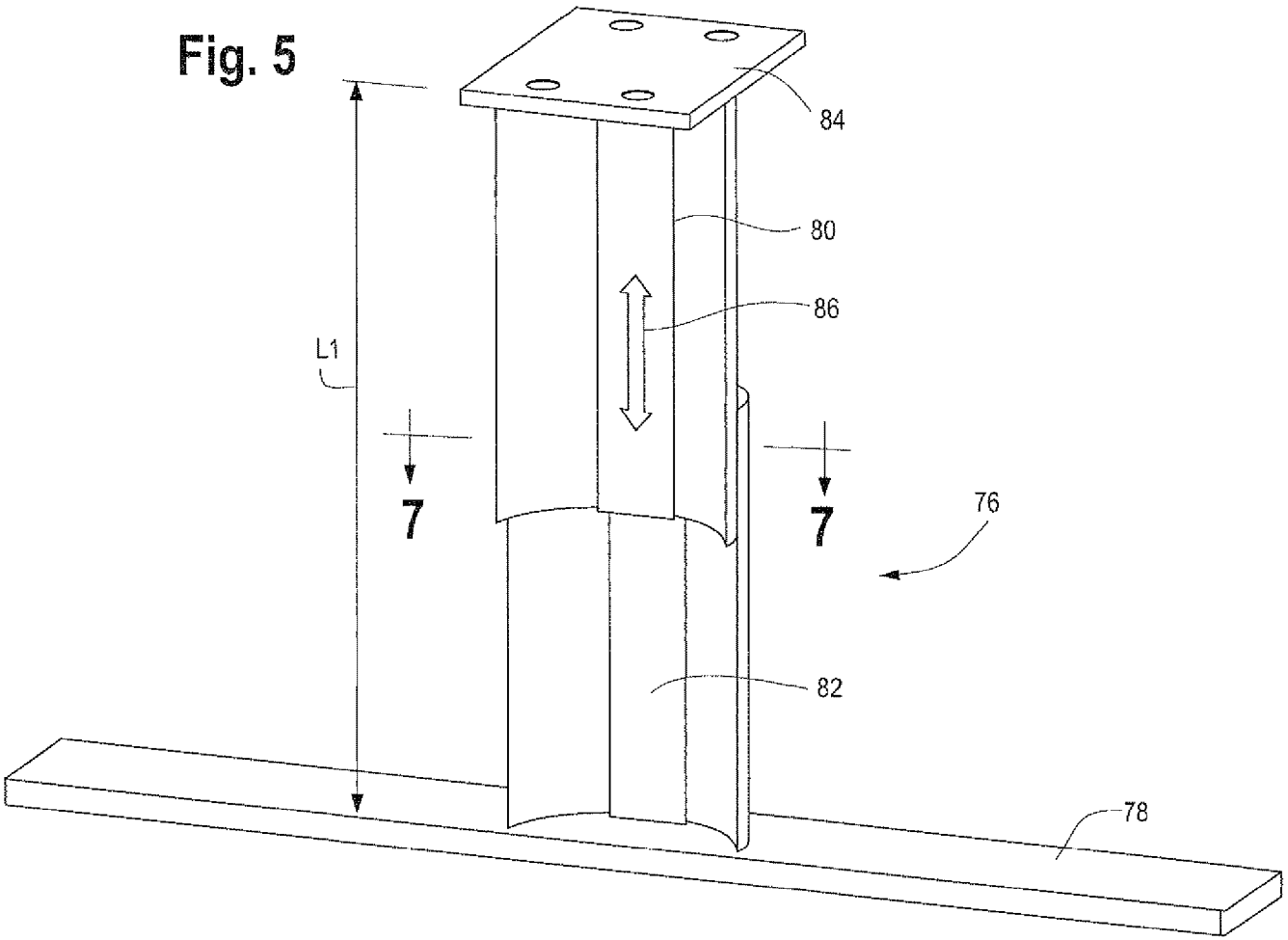
FIG. 5 is a perspective view of a support assembly as in FIG. 4, made according to the present invention.
Figure 7:
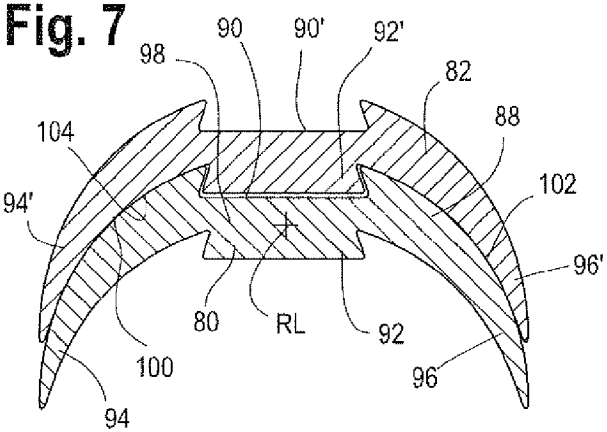
FIG. 7 is a cross-sectional view of the cooperating elements taken along the line 7-7 of FIG. 5.
Figure 8:
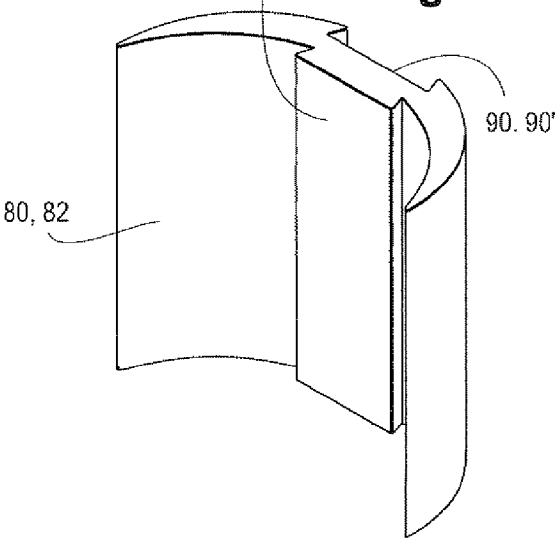
FIG. 8 is a perspective view of a discrete length of one of the cooperating elements.
Figure 6:
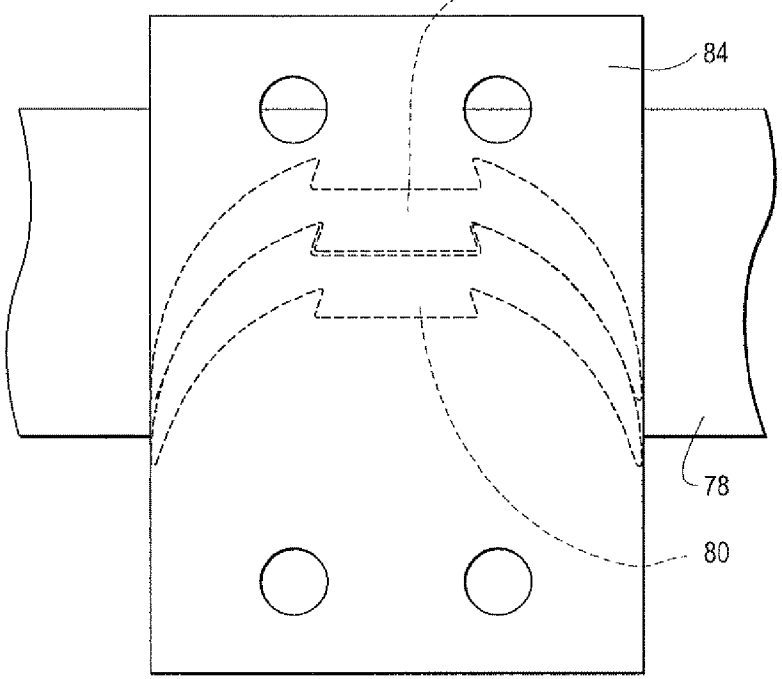
FIG. 6 is an enlarged, fragmentary, plan view of the support assembly in FIG. 5 and consisting of two cooperating elements.

In FIG. 4, a conventional support assembly, as for the extruded frame element 20 and member 18, is shown at 54. The support assembly 54 has a base 56 that bears on a subjacent surface 58. First and second vertically extending, elongate elements 60, 62 are telescopingly engaged with each other whereby the combined length L thereof can be changed. The first element 60 has a flange 64 to which the extruded frame element 20, or like functioning part, can be attached.

In this embodiment, the elements 60, 62 have a complementary square cross-sectional configuration taken transversely to their lengths. The element 62 has a through opening 66 that can be selectively registered with vertically spaced openings 68 in the element 60. With the elements 60, 62 relatively positioned in a vertical direction so that a desired length L is achieved, a bolt 70 can be directed through the opening 66 and the registered opening 68 to fix this relationship.

As mentioned in the Background Art portion herein, the outside surface 72 of the element 60 and inside surface 74 of the element 62 must be sized so that guided sliding movement therebetween can be effected with minimal binding. At the same time, a significant gap therebetween may allow play that is detrimental in terms of overall stability.

In FIGS. 5-8, a support assembly 76, functioning as the conventional support assembly 54 but made according to the invention, is shown. The support assembly 76 consists of a base 78, cooperating first and second elements 80, 82, and a flange 84 on the element 80 for directly or indirectly engaging the extruded frame element 20, or other component that defines or supports a member defining a maneuvering surface.

The first and second elements 80, 82 define a vertical support subassembly. The elements 80, 82 are keyed, each to the other, to be: a) guided against each other in a vertical line, indicated by the arrow 86 and identified as a reference line RL in FIG. 7, to define a variable combined vertical length L1, and b) keyed against movement relative to each other around the vertical line RL.

Each of the elements 80, 82 has the same cross-sectional configuration taken transversely to the length thereof and thus can be formed from the same stock material, that lends itself to manufacture as by an extrusion process. Exemplary element 80 has a body 88 with a curved configuration that is generally U-shaped opening in a horizontal direction. At one side of a base portion 98 of the "U", a trapezoidally-shaped slot 90 is formed, with a complementary trapezoidally-shaped rib 92 on the opposite side thereof. The legs 94, 96 of the "U" taper away from the base portion 98.

The element 82, as noted above, has the same cross-sectional shape with a slot 90', rib 92', and legs 94', 96'.

The elements 80, 82 can be operatively engaged by directing the rib 92' downwardly into and through the slot 90 to achieve the desired combined length L1. The complementary trapezoidal shapes of the rib 92' and slot 90 key the elements 80, 82 against relative movement other than in a direction parallel to the vertical line 86.

Additional stability is afforded by configuring the elements 80, 82 so that the legs 94, 96 nest within a receptacle 100 defined by the legs 94', 96'. That is, a surface 102 defined by the legs 94, 96 is closely engaged by a surface 104 bounding the receptacle 100. With this arrangement, the element 82 wraps partially around the element 80 and the elements 80, 82 become mutually reinforcing over a substantial distance around the vertical reference line RL.

Figure 9:
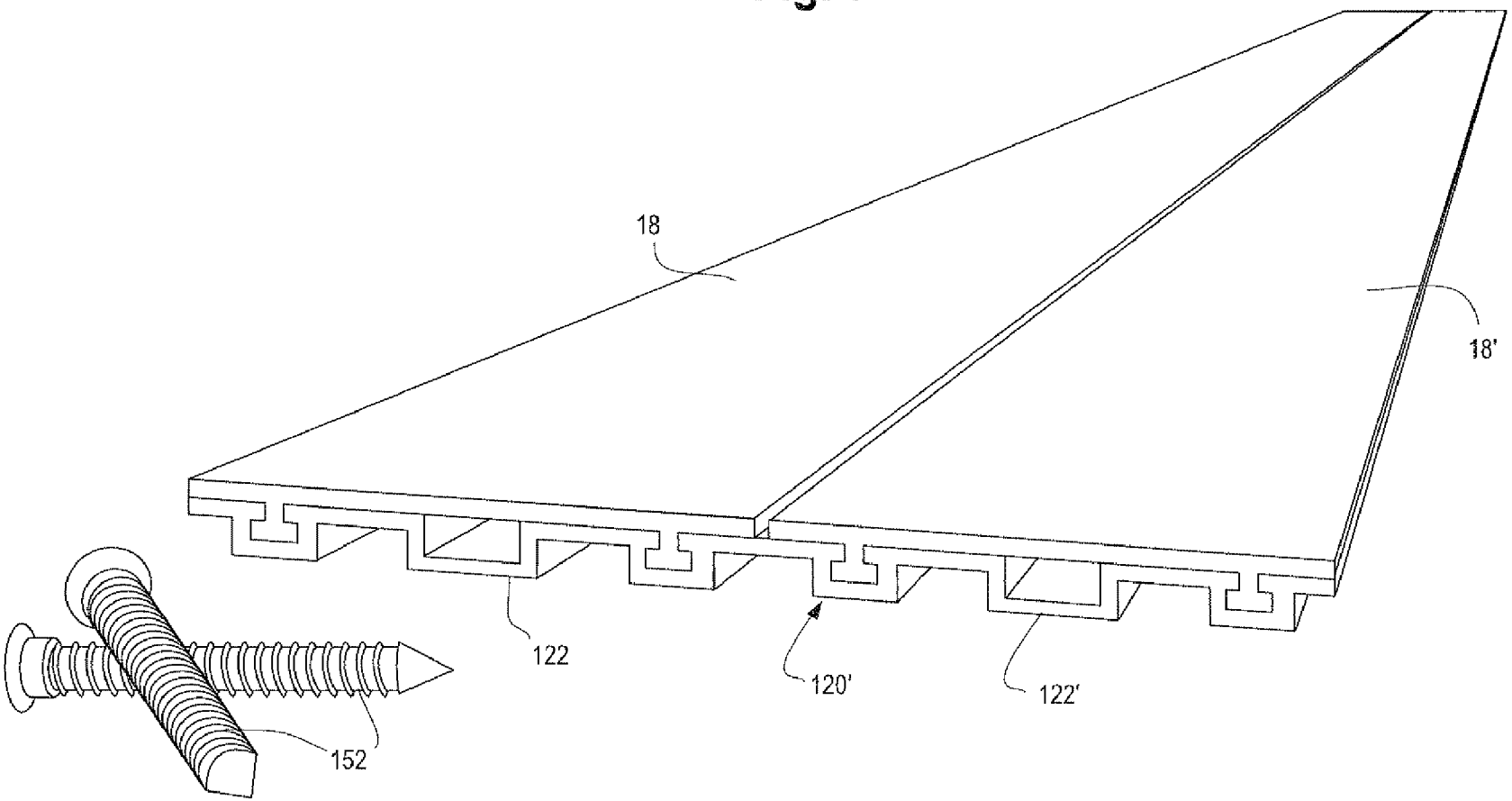
FIG. 9 is a perspective view of a frame element on a modified form of support and cooperating member defining a maneuvering surface, as depicted schematically in FIG. 1.
Figure 10:
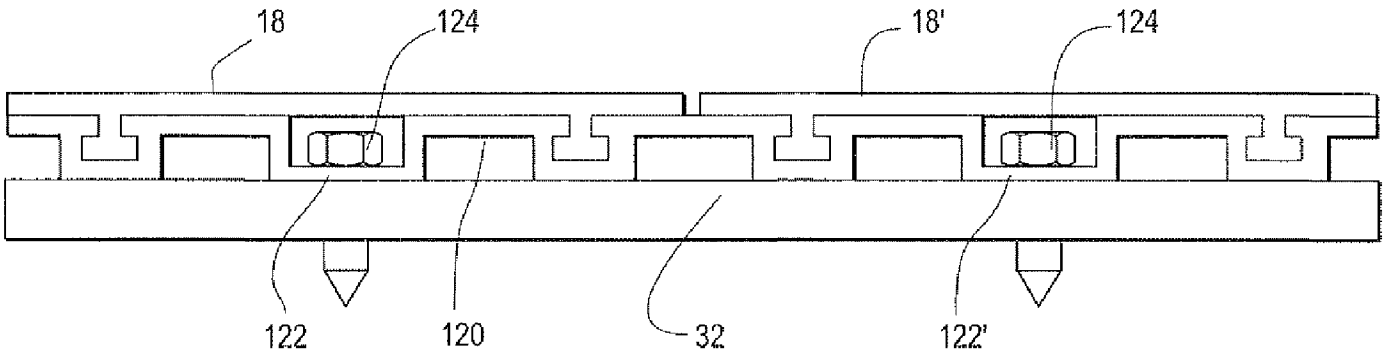
FIG. 10 is an elevation view of the frame element and member in FIG. 9.

In FIGS. 9 and 10, a variation of the extruded frame element 20 is shown at 120. The frame element 120 has a modified cross-sectional configuration and differs from the frame element 20 primarily by reason of defining upwardly opening, U-shaped anchoring portions 122, 122' through which threaded anchors/fasteners 124 are directed to secure a connection between the extruded frame element 120 and the aforementioned support flange 30, or like component.

The members 18, 18' are attached to the unitary extruded frame element 120. Of course, a single member might be utilized in this and other embodiments. The connection between the extruded frame element 120 and the members 18, 18' is substantially the same as described for the embodiment shown in FIGS. 2 and 3.

As noted above, the invention contemplates a multitude of different anchors 52 that fix/block the member 18 against movement relative to the support 14, as shown in schematic form in FIG. 11. This schematic showing is intended to encompass the embodiments disclosed herein and virtually an unlimited number of different embodiments that are based upon the inventive concepts set forth herein.

Figure 12:
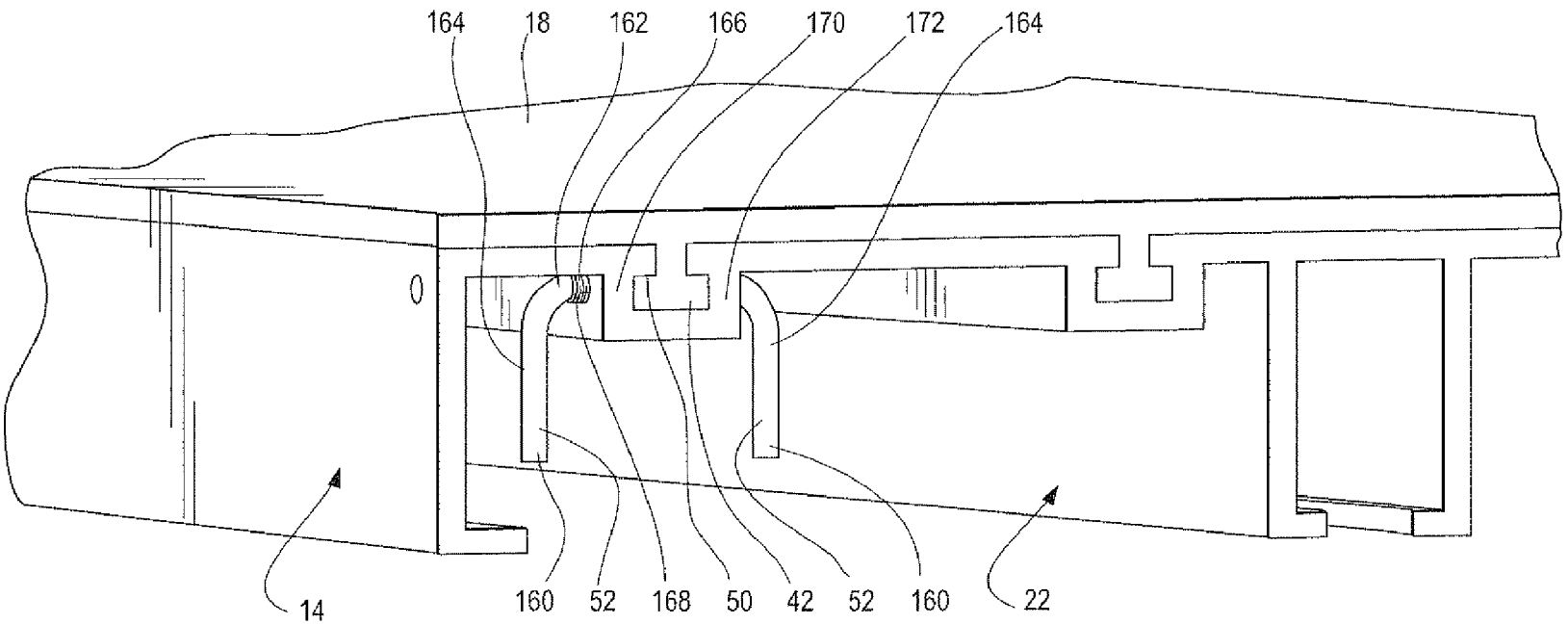
FIG. 12 is a fragmentary, perspective view of one specific form of anchor cooperating between a member and frame element on a support as in FIG. 11.

In FIG. 12, one specific form of the anchor 52 is shown for fixing the member 18 against lengthwise movement relative to the frame element 20 on the support 14.

Each anchor 52 has an L-shaped body 160 with transverse legs 162, 164. The legs 162 have threads 166 that can be engaged with threads in bores 168 (one shown) extending horizontally through spaced support parts 170, 172.

By grasping the legs 164, the anchors 52 can be turned to project into the slot 50 against the T-shaped element 42 therein. By reason of directing the legs 162 oppositely to against the T-shaped element 42, the T-shaped element is deformed and thereby compressed fixedly within the slot 50.

It is also contemplated that the free ends of the legs 162 might be configured to locally deform the T-shaped element 42, as by making the engaging leg end pointed or sharp, to thereby fix the member 18 against lengthwise movement relative to the support 14. With this arrangement, it is possible to use a single anchor 52. A single anchor 52 might also be used to effect the degree of compressive deformation of the element 42 within the slot 50 necessary that the member 18 will not shift lengthwise relative to the support 14 in use.

The anchors 52 can be turned in a loosening direction to allow the member 18 to be separated from the support 14 as for repair or replacement thereof.

Alternatively, threads 166 might be eliminated to provide a press fit arrangement for the anchor legs 162.

Figure 13:
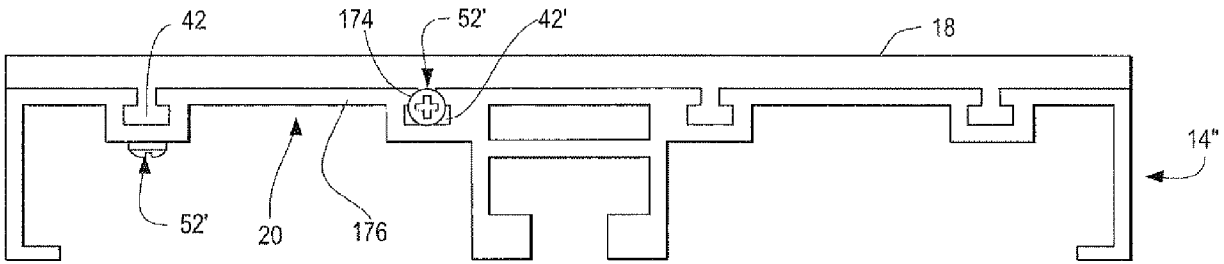
FIG. 13 is an end elevation view of a frame element and support as in FIG. 12 with another form of anchor.
Figure 14:
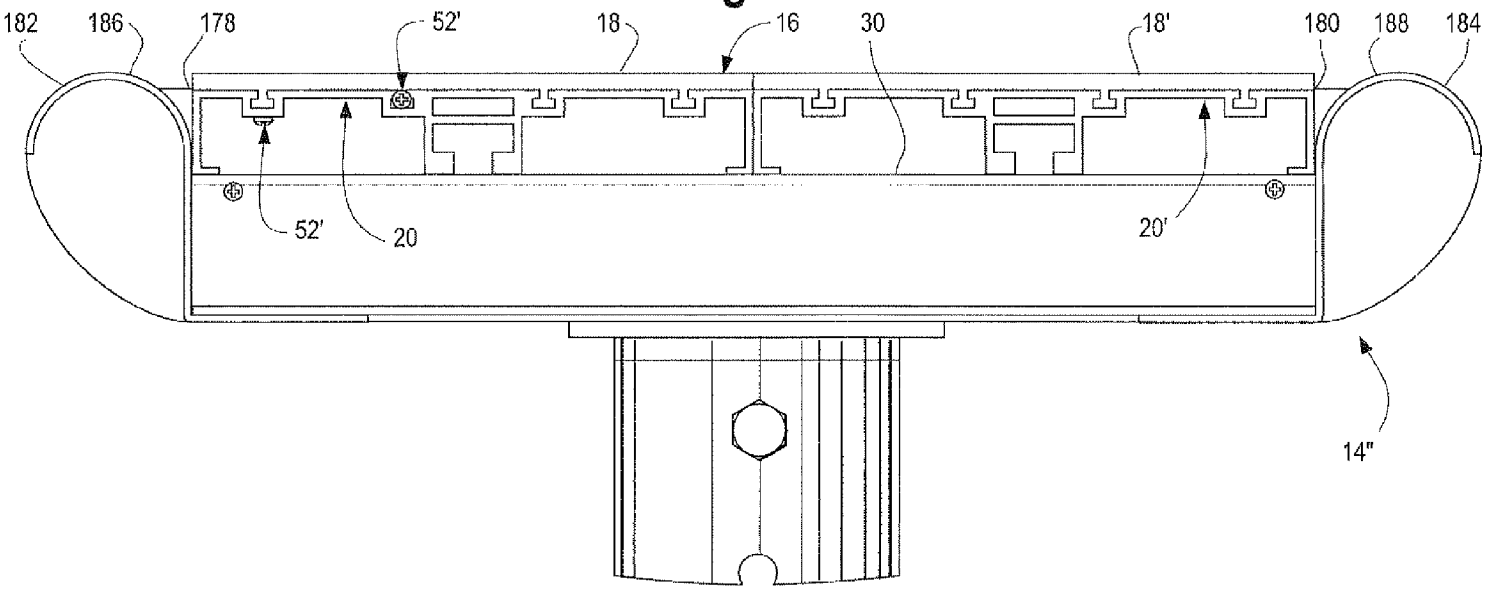
FIG. 14 is an end elevation view of the member and frame element in FIG. 13 with other support elements, including portions defining laterally confining grind surfaces.

In FIGS. 13 and 14, a modified form of support 14" is shown for the members 18, 18'. The support 14" has the aforementioned frame elements 20, 20' that are supported upon the support flange 30.

In this embodiment, the anchor 52' is in the form of a threaded fastener that is directed lengthwise into the end of one of the T-shaped elements 42'. An enlarged head 174 on the anchor 52' overlies one lengthwise end 176 of the frame element 20. By directing a like anchor 52' oppositely into the other end (not shown) of the frame element 20, the length of the frame element 20 between its ends 176 (one shown) becomes captive between the spaced anchor heads 174 to thereby prevent lengthwise shifting of the operatively joined member 18 relative to the support 14".

Multiple anchors can be provided at each end of the member 18. A similar arrangement is used to maintain the member 18' against lengthwise shifting relative to the support 14".

A separate anchor 52' is also shown directed upwardly through the frame element 20' into the T-shaped element 42. This anchor 52' may be used instead of, or in addition to, the end anchors 52'.

As seen in FIG. 14, the support 14" has laterally spaced first and second edges 178, 180 spaced transversely to the line indicated by the double-headed arrow 24 (FIG. 3). Spaced support portions 182, 184 project upwardly to define convex surfaces 186, 188 above and adjacent to the edges 178, 180, respectively. The surfaces 186, 188 define discrete grind surfaces that function as the primary load bearing components and additionally limit wear on the lateral edges of the members 18, 18' that might eventually lead to an unwanted exposure of the support edges 178, 180 after extended use. The support portions 182, 184 are shown as separate members attached to extend along substantially the full lengthwise extent of the members 18, 18'.

Figure 15:
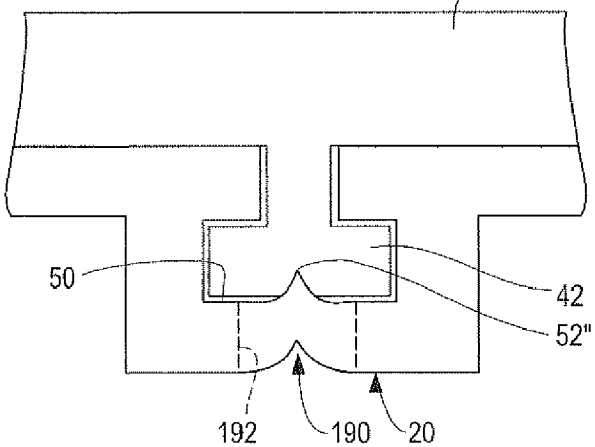
FIG. 15 is an enlarged, fragmentary, end view of an element on a member within a groove on a frame element with another form of anchor, according to the present invention.

As shown in FIG. 15, as an alternative to using a separate component, the anchor 52" therein for the member 18 is shown integrally formed with the frame element 20. The anchor 52" may be formed by locally deforming the material of the frame element 20, as shown at 190. This may be accomplished as by using a punch and a hammer so that the material making up the frame element 20 presses into and deforms the exemplary T-shaped element 42 within the slot 50, thereby to produce a wedging action that prevents relative lengthwise movement between the member 18 and the frame element 20.

This process may be carried out to produce any desired number of the anchors 52" at any location where the frame element 20 and member 18 are in abutting or adjacent relationship.

In the event that it is desired to separate the member 18, a core 192 may be formed through the frame element 20, as by using a conventional rotary drill and coring cutter, to remove a frame element portion with the anchor 52" formed thereon.

Figure 16:
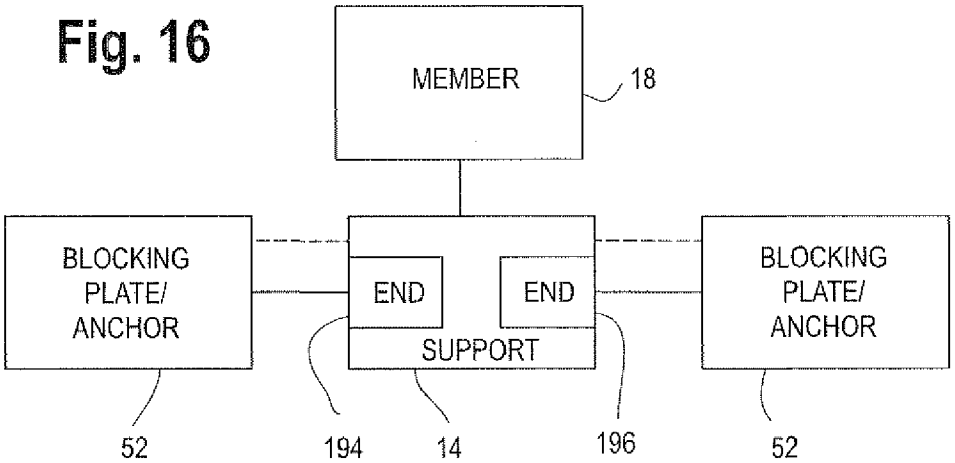
FIG. 16 is a schematic representation of a component with a member and support and showing another form of anchor/blocking plate.

In FIG. 16, a modified form of anchor 52 is shown for use in confining lengthwise relative movement between the member 18 and support 14. In this embodiment, the anchor 52 is in the form of a blocking plate. One blocking plate/anchor 52 is provided at each of the opposite lengthwise ends 194, 196 of the support 14 to produce a captive arrangement for the member 18. The blocking plate/anchors 52 may be attached directly at the support ends 194, 196, or elsewhere as shown in dotted lines in the schematic depiction of the system in FIG. 16.

Figure 17:
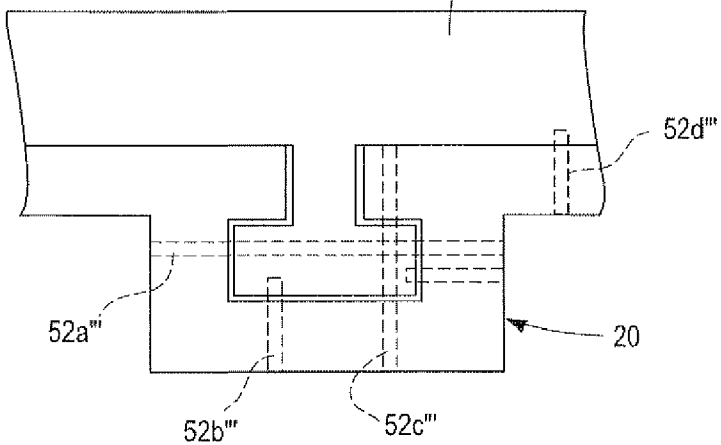
FIG. 17 is a view as in FIG. 15 showing yet another form of anchor, according to the invention.

In FIG. 17, a still further modified form of anchor is shown at 52''', in the form of a pin or a wire that may be threaded or unthreaded. The anchor 52''' is shown at four different locations as 52*a*'''', 52*b*''', 52*c*''', and 52*d*'''. These are only representative locations, as the anchor 52''' may be projected into the member 18 and frame element 20 at other locations. The anchor 52*a*''' is shown extending fully through the member 18 and frame element 20 at one location. At the other locations, the anchors 52*b*''', 52*c*''', 52*d*''' extend only partially through both of the member 18 and frame element 20 in the extension line therefor. The invention contemplates that other locations for the anchors 52''' might be utilized solely or in conjunction with any one or more of the locations indicated in FIG. 17. Also, the anchor 52''' may be inserted so that its length is angled to horizontal and vertical.

All of the anchors described above that are separate elements might be simply press-fit into place or, alternatively, may require the use of tools, as when they are in a threaded form. As just one example, the blocking plates/anchors 52 might be held in place by fasteners or simply pressed into a receptacle to perform the described function.

Figure 18:
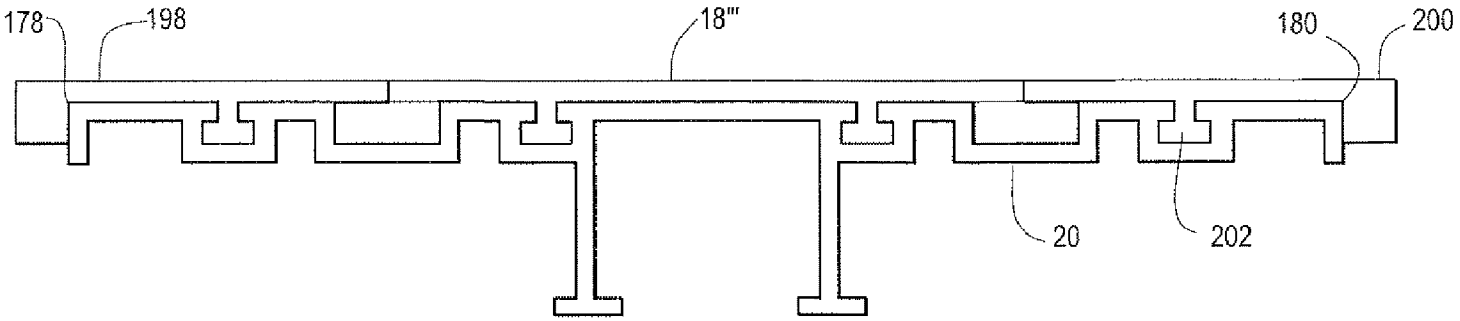
FIG. 18 is an end elevation view of a frame element with a member and edge guards operatively joined to the frame element.
Figure 19:
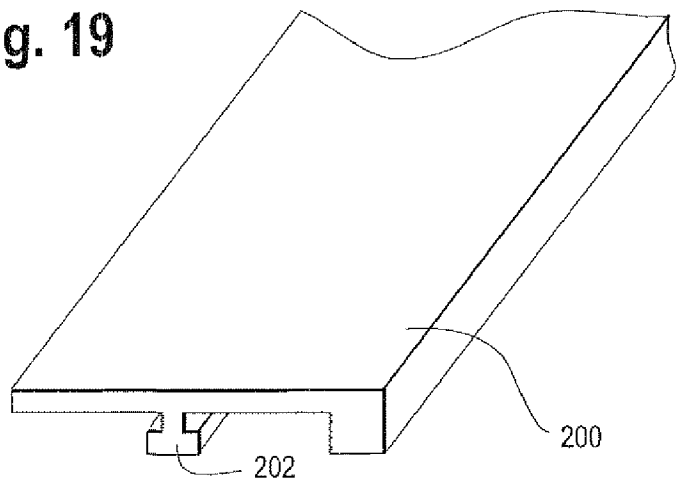
FIG. 19 is a fragmentary, perspective view of one of the edge guards in FIG. 18.

Another aspect of the invention is shown in FIGS. 18 and 19 and consists of edge guards 198, 200 that extend lengthwise coextensively with the exemplary member 18''' with respect to the underlying frame element 20.

The edge guards 198, 200 wrap respectively around the support edges 178, 180 to prevent inadvertent contact between a user's board/ski 13 and the support edges 178, 180 in use.

While the edge guards 198, 200 are shown as elements separate from each other and the member 18''', these components could be formed as one piece. With the multi-piece construction shown, there is no specific requirement as to the widths of the edge guards 198, 200 and member 18''' or any other member(s) (not shown) that might be used. It is preferred that each edge guard 198, 200 have an inverted T-shaped element, shown at 202 for the representative edge guard 200, and corresponding in function to the T-shaped element 42''', described above. Installation of the edge guards 198, 200 can thus be effected by aligning the edge guards 198, 200 with the frame element 20 and effecting lengthwise relative movement to achieve the operative joined relationship for these components. Snap fitting of these components is also possible.

Figure 20:
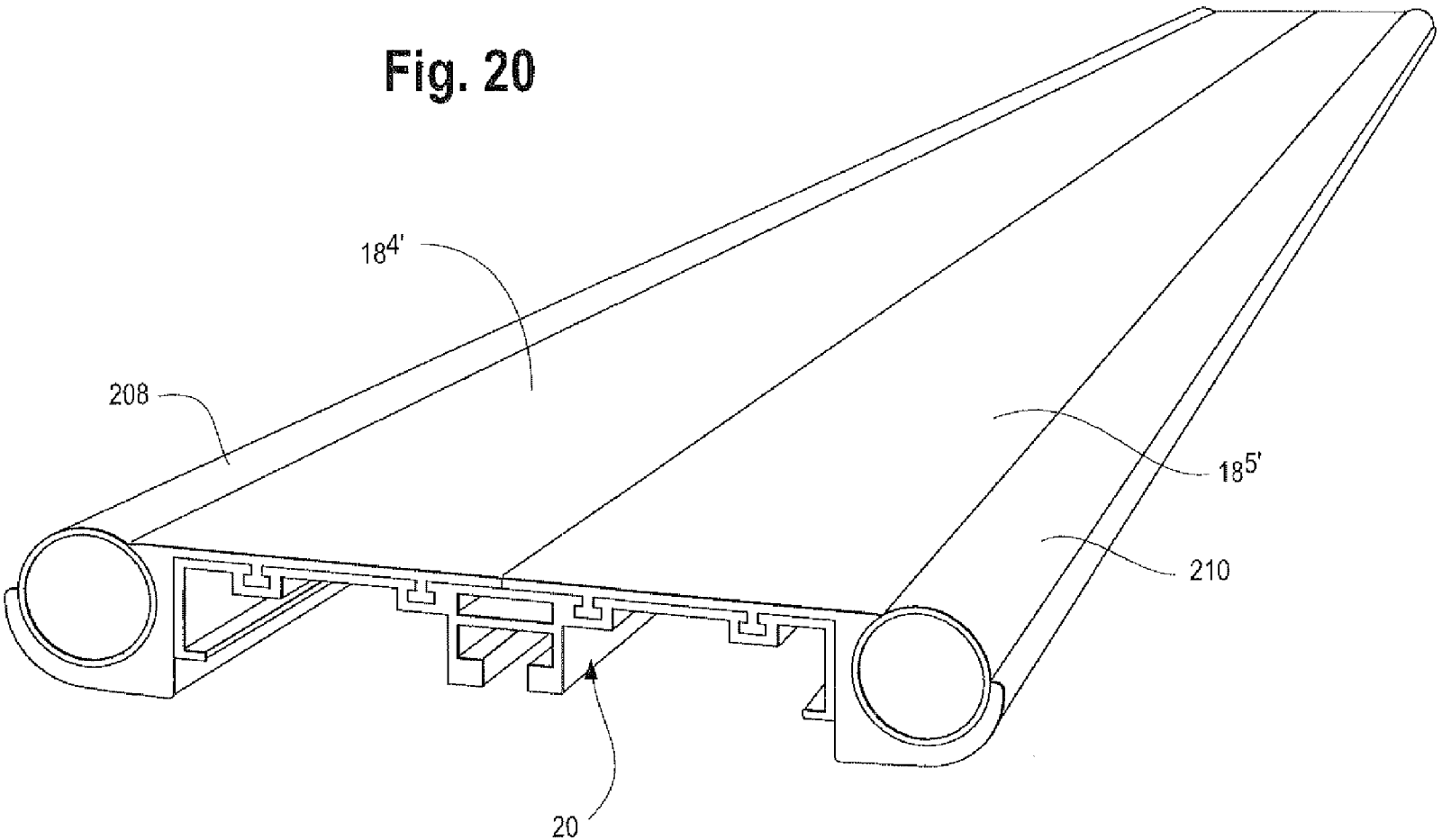
FIG. 20 is a perspective view of a frame element with another form of member joined thereto and defining a maneuvering surface and receptacles for laterally spaced grind members.
Figure 21:
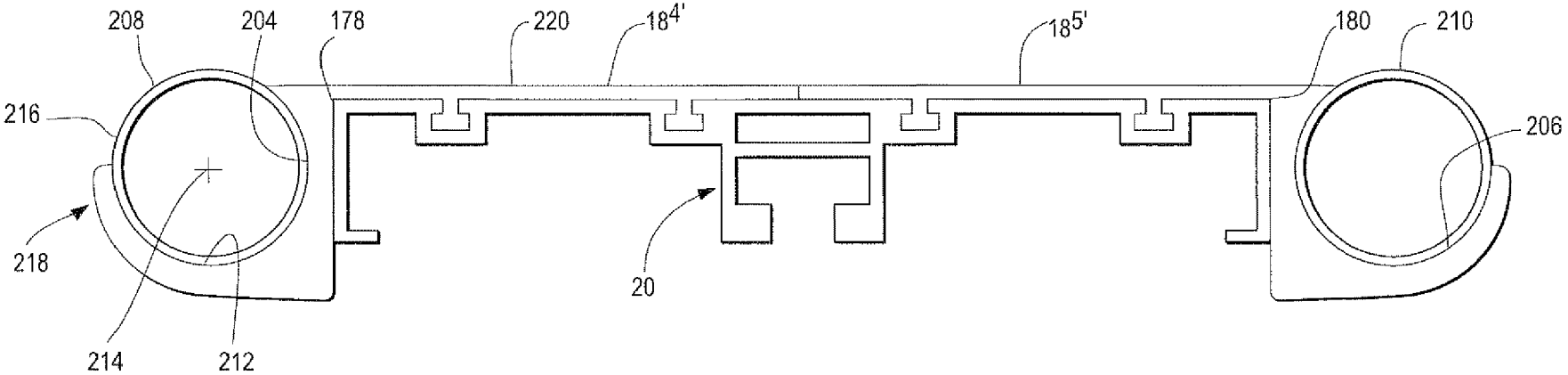
FIG. 21 is an end elevation view of the components in FIG. 20.

In FIGS. 20 and 21, members $18^{4'}$, $18^{5'}$ are shown that are operatively joinable with the aforementioned frame element 20, in the same manner as are the members 18, 18', 18", 18'''. The members $18^{4'}$, $18^{5'}$, in addition to wrapping around the support edges 178, 180, respectively define receptacles 204, 206 for grind members 208, 210, respectively.

Exemplary member $18^{4'}$ has a surface 212 that extends through in excess of 180° around an axis 214. The surface 212 has a radius that may be constant with respect to the axis 214 through the circumferential extent thereof.

The grind member 208 has an outer surface 216 that is complementary to the shape of the surface 212. The surface 216 may be circular in cross-section and centered on the axis 214. By reason of the receptacle surface 212 extending through greater than 180°, the grind member 208 may be press-fit into the receptacle 204 by deforming the member portion 218. That is, by deforming the free end portion 218 radially outwardly, the grind member 208 can be pressed into the receptacle 204, whereupon the portion 218 springs back to captively hold the grind member 208 in place. The grind member 208 is shown to have an elongate tubular configuration over its whole length, which is coextensive with the members 18$^{4'}$, 18$^{5'}$.

Alternatively, the grind members 208, 210 and their respective receptacles may be relatively configured so that the grind members 208, 210 can each be aligned with, and thereafter slid lengthwise into place into, a receptacle. This obviates the need to make the members 18$^{4'}$, 18$^{5'}$ reconfigurable where they engage the grind members 208, 210, respectively.

The outer surface 216 of the grind member 208 is convexly curved and has a portion at or above the maneuvering surface 220, defined by the members 18$^{4'}$, 18$^{5'}$, that is the primary weight bearing grind region at the side of the maneuvering surface.

Figure 23:
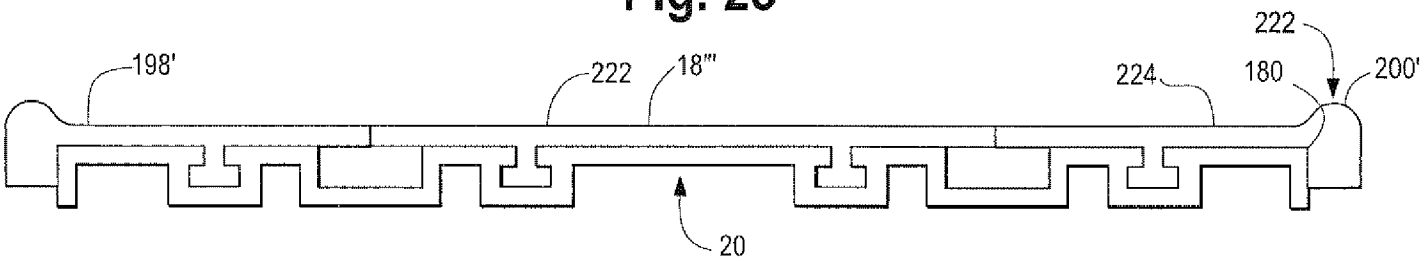
FIG. 23 is a fragmentary, perspective view of one of the edge guards in FIG. 22.
Figure 22:
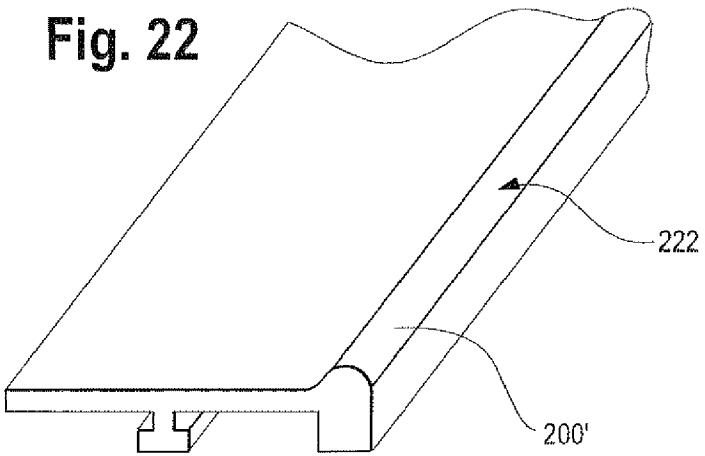
FIG. 22 is a view as in FIG. 18 and showing a modified form of edge guard.

In FIGS. 22 and 23, modified forms of edge guards 198', 200', corresponding to the edge guards 198, 200 in FIGS. 18 and 19, are shown. The edge guards 198', 200' and member 18''' are joined to the frame element 20 in the same manner as are the edge guards 198, 200, and member 18'''. The only significant difference is that the exemplary edge guard 200' is locally thickened in the region at 222 in a vertical direction above the maneuvering surface 222. The edge guard 200' wraps around the support edge 180. By reason of being thickened at the location 222, this region can be worn down considerably before the edge 180 is exposed. This feature is desirable from the standpoint that users will regularly "grind" at the lateral edge locations and thereby cause progressive wear.

The upper surface 224 of the edge guard 200' is crowned and convexly curved at the location 222.

Figure 24:
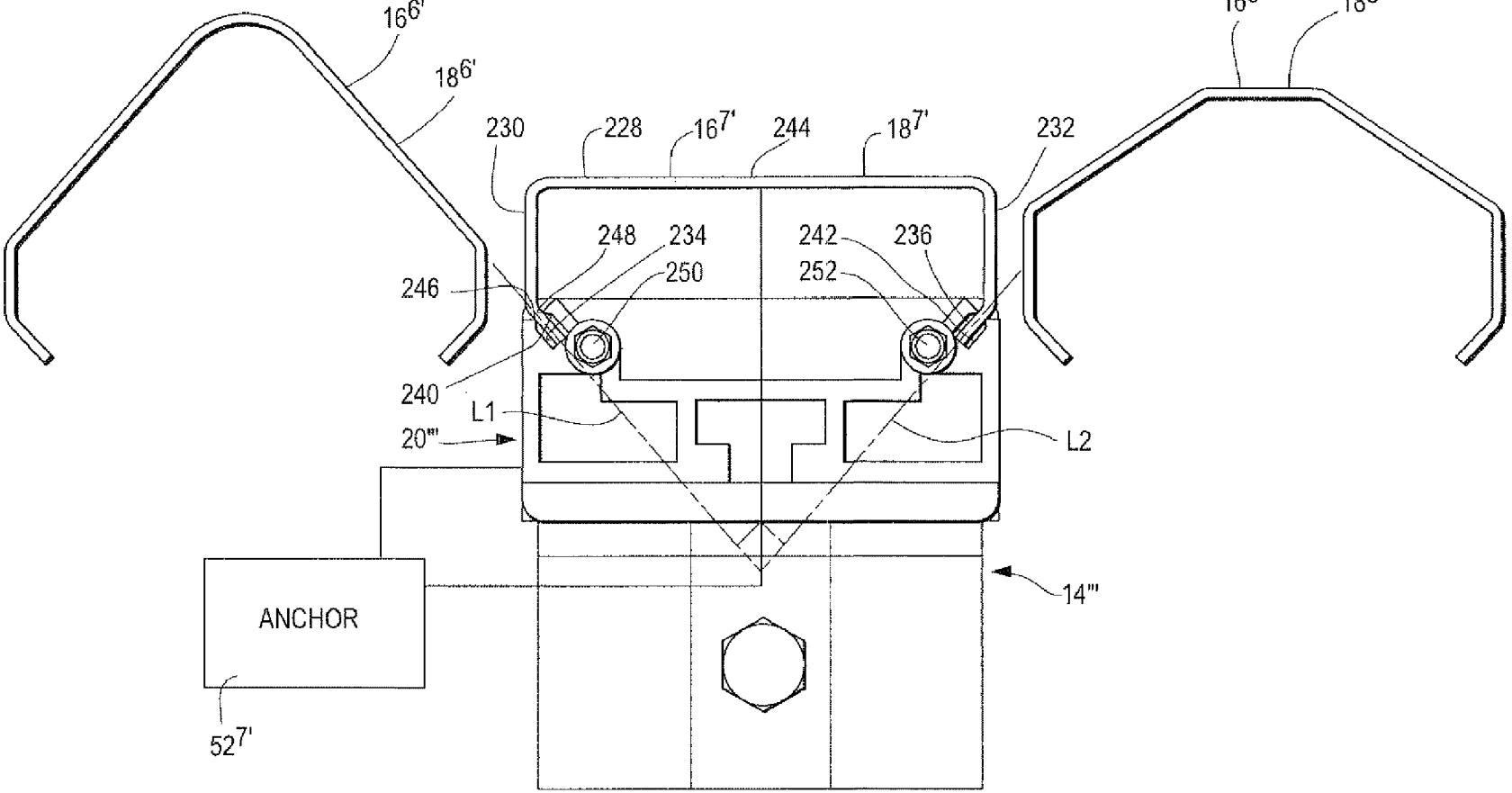
FIG. 24 is an end elevation view of a modified support, according to the invention, and three different members that are interchangeably joinable to the support.

In FIG. 24, a further modified form of the invention is shown with a modified form of support 14''' that is designed so that different members 18$^{6'}$, 18$^{7'}$, 18$^{8'}$ can be selectively operatively joined thereto, one in place of the other. The members 18$^{6'}$, 18$^{7'}$, 18$^{8'}$ are configured to define different configurations of maneuvering surface 16$^{6'}$, 16$^{7'}$, 16$^{8'}$. The three different maneuvering surface shapes are but exemplary in nature. Each of the members 18$^{6'}$, 18$^{7'}$, 18$^{8'}$ has an inverted "U" shape.

Exemplary member 18$^{7'}$ has a "U" shape with a base 228 and spaced legs 230, 232. The legs 230, 232 have inturned free ends 234, 236, respectively.

The support 14''' has a frame element 20''' that defines slots 240, 242 to respectively receive the leg ends 234, 236.

The legs 230, 232 are elongate members that are slid lengthwise of the support 14''' into the slots 240, 242. The slots 240, 242 respectively open along lines L1, L2 that are substantially orthogonal to each other, though this is not a requirement. Each of the lines L1, L2 makes an acute angle with the plane of a flat portion 244 of the maneuvering surface 16$^{7'}$ at the base of the "U".

With this arrangement, the angled leg ends 234, 236 within the slots 240, 244 prevent vertical withdrawal of the member 18$^{7'}$ and limit opposite lateral shifting of the member 18$^{7'}$ relative to the support 14'''.

The support 14''' has elements 246, 248 projecting laterally into the slot 240 to effectively diminish the width of the slot 240. These elements 246, 248 may be provided at a single location or at multiple discrete locations to securely hold the leg end 234 without creating excessive friction as the member 18$^{7'}$ is installed. A like arrangement is provided at the slot 242.

A separate anchor 52$^{7'}$ may be used to cooperate between the member 18$^{7'}$ and support 14''' to fix the relative lengthwise position thereof or confine relative lengthwise movement therebetween.

Fasteners 250, 252 at the one end of the support 14''' may be used to operatively mount the anchor 52$^{7'}$. As one example, the anchor 52$^{7'}$ may be an end plate held in place by the fasteners 250, 252.

The opposite support end (not shown) may have a fixed abutment or a separate anchor 52$^{7'}$ that may be put in place with the member 18$^{7'}$ joined to the support 14'''.

Figure 25:
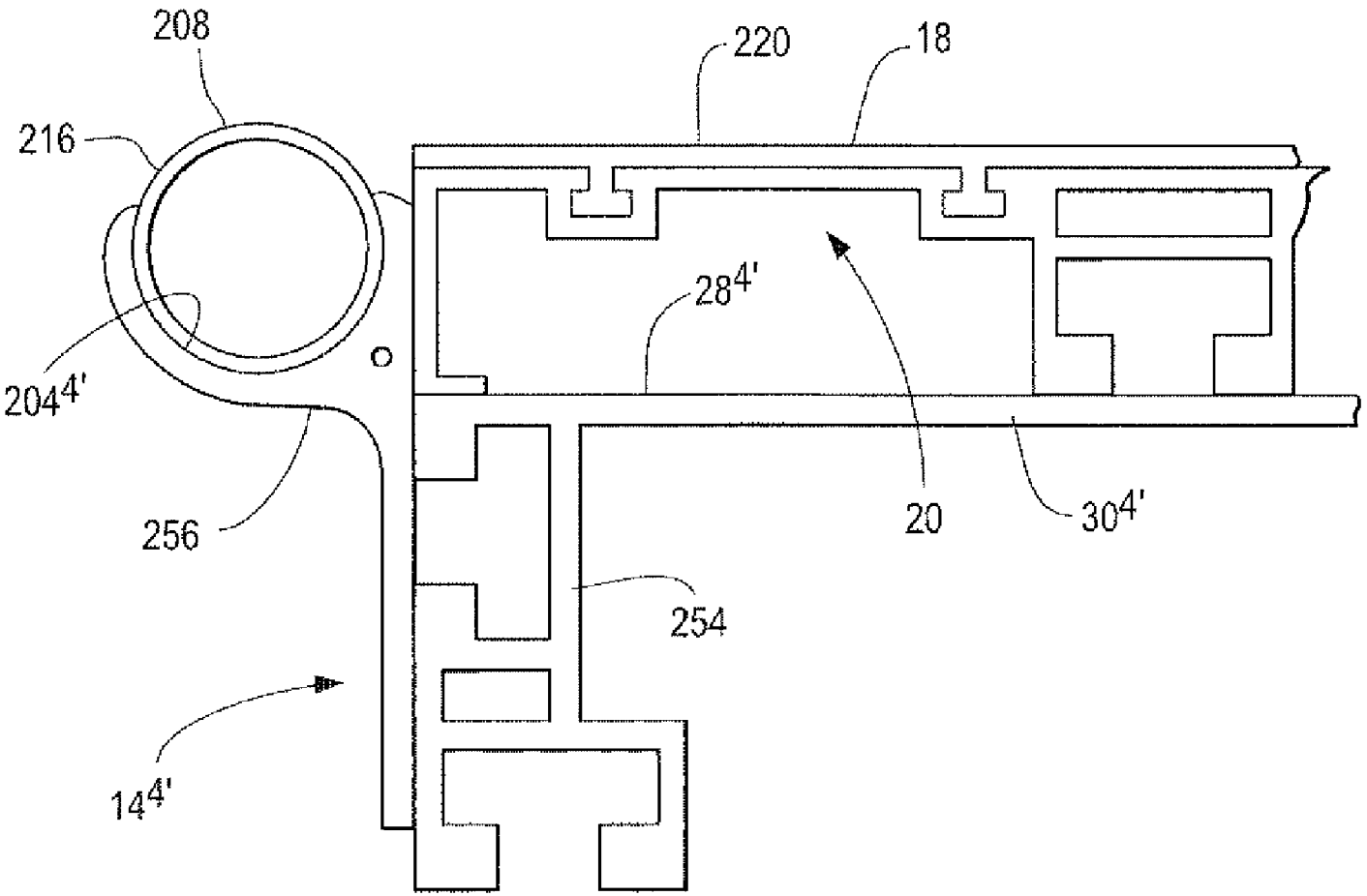
FIG. 25 is a fragmentary, end elevation view of a modified form of support, according to the invention, to accommodate grind members as shown in FIG. 20.

In FIG. 25, a modified form of support for the frame element 20 is shown at 14$^{4'}$. The frame element 20 is shown with the member 18 operatively joined thereto.

In this embodiment, the support 14$^{4'}$ has a component 254 with an integrally formed flange 30$^{4'}$ with an upper surface 28$^{4'}$ to bear the frame element 20. The support 14$^{4'}$ further has a side support 256 defining a receptacle 204$^{4'}$ for the grind member 208. The side support 256 is suitably secured to each of the frame element 20 and support component 254 so that the outer surface 216 of the grind member 208 resides slightly above the maneuvering surface 220 on the member 18.

The side support 256 may be extrusion formed and may extend as a single piece over an adequate length of the grind member 208 to rigidly support the same. Alternatively, the side support 256 may be made up of multiple, discrete lengths that cooperatively provide the required support for the grind member 208.

The grind member 208 and receptacle 204$^{4'}$ are relatively configured to allow the grind member 208 to be aligned with and slid lengthwise into the receptacle 204$^{4'}$. Alternatively, the side support 256 may have sufficient "give" that it will deform adequately to allow the grind member 208 to be vertically driven thereinto to produce a snap fit arrangement.

A similar arrangement (not shown) is provided for the grind member 210 on the opposite side of the support 14$^{4'}$.

Figure 26:
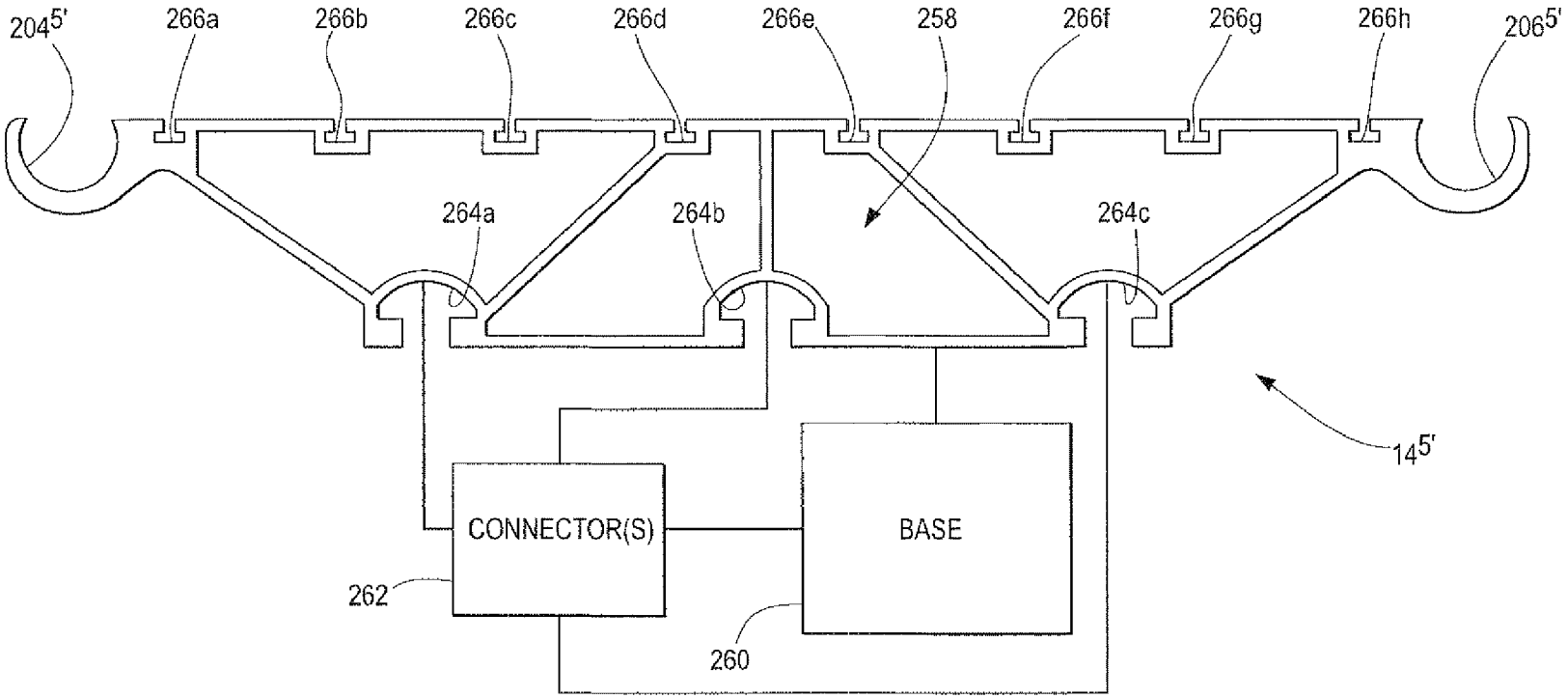
FIG. 26 is an end elevation view of a further modified form of support, according to the invention, including a component that defines a support for the grind members and the members defining the maneuvering surface.

In FIG. 26 a further modified form of support, according to the invention, is shown at 14$^{5'}$. The support 14$^{5'}$ consists of an integrated component 258 that may be formed as a single, extruded piece that is suitably secured to a base 260 to be maintained in an operative position relative to a subjacent surface. The component 258 may be connected to the base 260 through suitable connectors 262 designed to be provided, one each, in receptacles 264*a*, 264*b*, 264*c* on the component 258.

The component 258 has slots 266*a*, 266*b*, 266*c*, 266*d*, 266*e*, 266*f*, 266*g*, 266*h* designed to cooperatively receive complementary shaped parts on one or more members (not shown) defining a maneuvering surface, as hereinabove described.

The component 258 additionally defines receptacles 204$^{5'}$, 206$^{5'}$ to receive the aforementioned grind members 208, 210, or a grind member having a different configuration. The grind members 208, 210 may be slid lengthwise, or snapped, one each into a receptacle 204$^{5'}$, 206$^{5'}$.

Figure 27:
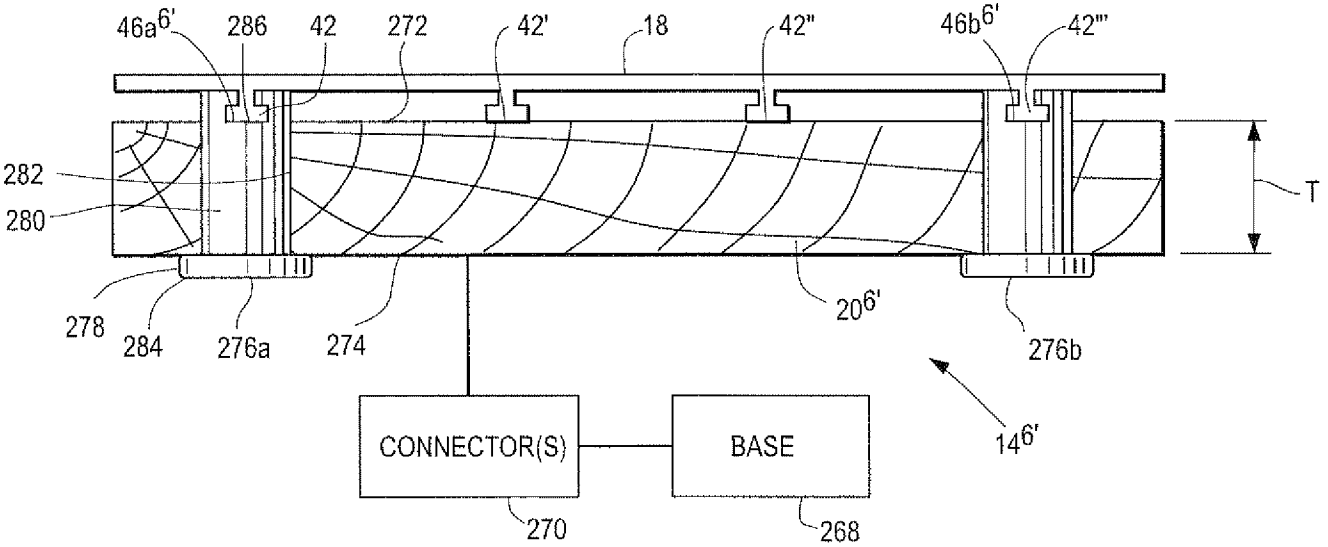
FIG. 27 is a fragmentary, partial cross-sectional view of a modified form of support, according to the invention, including mounting clips for the member(s) defining the maneuvering surface.
Figure 28:
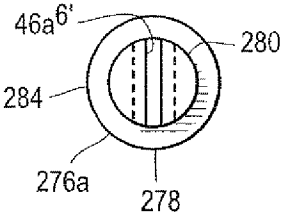
FIG. 28 is a plan view of one of the mounting clips in FIG. 27.

In FIGS. 27 and 28, a further modified form of support, according to the present invention, is shown at 14$^{6'}$. The support 14$^{6'}$ is designed to maintain the exemplary member 18 in an operative position relative to a subjacent surface.

More particularly, the support 14$^{6'}$ consists of a frame element 20$^{6'}$ that is supported upon a base 268 that bears upon a subjacent surface. The frame element 20$^{6'}$ may be suitably secured to the base 268, as through one or more connectors 270.

The frame element 20$^{6'}$ has an upwardly facing surface 272 and a downwardly facing surface 274, with a thickness T defined therebetween.

Mounting clips 276*a*, 276*b* are provided to define slots 46*a*$^{6'}$, 46*b*$^{6'}$, respectively for the elements 42, 42''' respectively on the member 18.

The exemplary mounting clip 276*a* has a body 278 with a main cylindrically-shaped portion 280 that is press fit through a complementary bore 282 through the frame element 20$^{6'}$. An enlarged head 284 abuts to the surface 274 and thereby arrests upward movement of the mounting clip 276*a* at a position wherein the bottom surface 286, bounding the slot 46*a*$^{6'}$, is substantially flush with the upwardly facing surface 272. With this arrangement, the element 42 can be directed lengthwise into the slot 46*a*$^{6'}$ to join the member 18 to the support 14$^{6'}$. The element 42''' cooperates with the mounting clip 276*b* in like fashion.

With the member 18 operatively joined to the support 14$^{6'}$, the elements 42', 42'' on the member 18 abut to the upwardly facing surface 272 on the frame element 20$^{6'}$.

The mounting clips 276 can be strategically placed so that the member 18 can be slid into joined relationship with the support 14$^{6'}$ and maintained against lateral shifting as in the prior embodiments. For example, two or more of the mounting clips 276*a* can be provided to cooperate with the element 42 at spaced lengthwise locations at one side of the member 18. The spaced mounting clips 276*a* thus cooperatively produce a slot component for receipt of the element 42. A like arrangement of the mounting clips 276*b* may be provided at the other side of the member 18.

Mounting clips (not shown) can also be used to cooperate in like fashion with one or both of the elements 42', 42''.

With this arrangement, it is possible to make the frame element 20$^{6'}$ from a single piece of material, including something as inexpensive and readily available as plywood, or any other metal, non-metal, or composite composition. This design lends itself to a relatively inexpensive construction.

Figure 29:
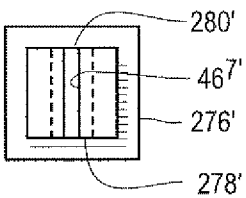
FIG. 29 is a view as in FIG. 28 of a modified form of mounting clip.

In FIG. 29, a modified form of mounting clip is shown at 276' and functions as the aforementioned mounting clip 276, with the exception that the main part 280' of the body 278' has a polygonal external shape whereby it will be keyed into a complementarily-shaped bore to thereby facilitate consistent lengthwise alignment of the slot 46$^{7'}$.

Any configuration of mounting clip that can be press fit into, and maintained in, a bore is contemplated. For example, a strip of flat material may be made with a width that will wedge into a receiving bore.

Figure 30:
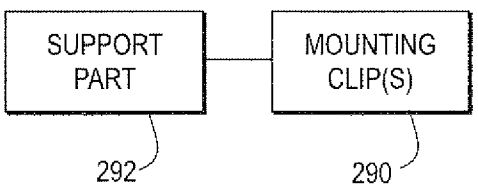
FIG. 30 is a schematic representation of a support for a member defining a maneuvering surface and utilizing one or more mounting clips.

As shown in FIG. 30, the invention contemplates that mounting clips, shown generically at 290, to include the above-noted mounting clip construction and others, may be attached to a support part 292 in a variety of different manners. For example, the mounting clip 290 might be provided on an upwardly facing surface on the support part 292 without extending therethrough, as the mounting clips 276 in FIG. 27. The FIG. 30 depiction is intended to encompass virtually any type of mounting clip arrangement that would permit snap fitting or slide fitting of a member relative to a support part using the basic inventive concepts disclosed herein.

One significant potential advantage that may be realized using the inventive concepts is that the maneuvering surface can be made to be uninterrupted over potentially the entire length of the individual component of which it is a part. Typically, the members defining the maneuvering surface are formed from sheet material that is conventionally 4×10 feet in dimension. Thus, maneuvering surfaces of greater than 10 feet require that successive lengths be butted end-to-end. This complicates assembly and also creates potential irregularities at the butting locations, that may be in the form of gaps, unmatched elevations, etc.

The foregoing disclosure of specific embodiments is intended to be illustrative of the broad concepts comprehended by the invention.

The invention claimed is:

1. An extreme sports component comprising:

a support; and at least a first member defining a maneuvering surface and joined operatively to the support, the support and at least first member operatively joined through at least one elongate member on one of the support and at least first member and a slot for receiving the one elongate member on the other of the support and at least first member, the one elongate member and slot each having a length, the one elongate member engageable within the slot so that the one elongate member is keyed against movement within the slot in directions other than along a first line, the lengths of the one elongate member and slot aligned in substantially parallel relationship.

2. The extreme sports component according to claim 1 wherein the at least first member and support are joined from a separated position by aligning the at least one elongate member and slot and relatively moving the at least first member and support along the first line.

3. The extreme sports component according to claim 1 wherein the extreme sports component further comprises at least one anchor that does not extend through the maneuvering surface and blocks the at least first member against movement relative to the support along the first line.

4. The extreme sports component according to claim 3 wherein the at least one anchor extends into the slot and the one, elongate member.

5. The extreme sports component according to claim 3 wherein the at least one anchor extends into the slot and to against the at least one elongate member.

6. The extreme sports component according to claim 3 wherein the at least one elongate member has an end and the at least one anchor defines a blocking surface that abuts to the end of the at least one elongate member to limit movement of the at least first member relative to the support along the first line.

7. The extreme sports component according to claim 1 wherein the slot is part of the support that is made through an extrusion forming process.

8. The extreme sports component according to claim 1 wherein the slot is part of the at least first member that is made through an extrusion forming process.

9. The extreme sports component according to claim 1 wherein the support has an edge and the at least first member wraps around the support edge.

10. The extreme sports component according to claim 1 wherein the support has laterally spaced first and second edges spaced transversely to the first line and the at least first member has a thickness that is locally thickened adjacent the first support edge.

11. The extreme sports component according to claim 1 wherein the support has laterally spaced first and second edges spaced transversely to the first line and the support has a portion that projects upwardly to define a grind surface at or above the first edge.

12. The extreme sports component according to claim 1 wherein the maneuvering surface comprises a non-metal material.

13. The extreme sports component according to claim 1 wherein the maneuvering surface comprises at least one of UHMW plastic, HPDE plastic, PVC plastic, a polymer, or a polymer composite.

14. The extreme sports component according to claim 1 wherein the at least member has an inverted "U" shape as viewed in cross section taken transversely to the first line with a base and spaced first and second legs, wherein the base defines the maneuvering surface and the first leg defines the one elongate member.

15. The extreme sports component according to claim 1 wherein the at least one elongate member and slot each has a fixed T-shaped cross-sectional configuration taken transversely to the length of the at least one elongate member and slot.

16. The extreme sports component according to claim 15 wherein the at least one elongate member and slot are each formed using an extrusion forming process.

17. The extreme sports component according to claim 1 wherein the maneuvering surface has an area and the support and at least first member have surfaces that facially engage each other over a majority of the area of the maneuvering surface.

18. An extreme sports component comprising:

a support; and at least a first member defining a maneuvering surface and joined operatively to the support, the support and at least first member operatively joined through at least one elongate member on one of the support and at least first member and a slot for receiving the one elongate member on the other of the support and at least first member, the elongate member engageable within the slot so that the one elongate member is keyed against movement within the slot in directions other than along a first line wherein the support has laterally spaced first and second edges spaced transversely to the first line and the at least first member defines a receptacle for a grind member that defines a surface at or above the maneuvering surface.

19. The extreme sports component according to claim 18 wherein the grind surface has a convexly curved shape.

20. The extreme sports component according to claim 18 wherein the grind member has an elongate tubular configuration.

21. The extreme sports component according to claim 20 wherein the receptacle and grind member are relatively configured so that the grind member can be one of snap fit or slide fit into and releasably maintained in the receptacle.

22. An extreme sports component comprising:

a support; and at least a first member defining a maneuvering surface and joined operatively to the support, the support and at least first member operatively joined through at least one elongate member on one of the support and at least first member and a slot for receiving the one elongate member on the other of the support and at least first member, the one elongate member engageable within the slot so that the one elongate member is keyed against movement within the slot in directions other than along a first line wherein the at least first member has an inverted "U" shape as viewed in cross section taken transversely to the first line with a base and spaced first and second legs, wherein the base defines the maneuvering surface and the first leg defines the one elongate member, wherein at least a part of the maneuvering surface resides in a plane, the support defines the slot and the slot opens in a line that is at a non-orthogonal angle with respect to the plane of the maneuvering surface.

23. In combination:

a support;

at least a first member defining a maneuvering surface and joined operatively to the support, the support and at least first member operatively joined through at least one elongate member on one of the support and at least first member and a slot for receiving the one elongate member on the other of the support and at least first member, the one elongate member engageable within the slot so that the one elongate member is keyed against movement within the slot in directions other than along a first line; and at least a second member defining a maneuvering surface that has a different configuration than the maneuvering surface defined by the at least first member, the at least first and second members releasably operatively joined, one in place of the other, to the support to allow a user to select a desired maneuvering surface configuration.

24. An extreme sports component comprising:

a support; and at least a first member defining a maneuvering surface, the support and at least first member each having a length, the support and at least first member operatively joined through at least one member on each of the support and at least first member that cooperate with each other so as to maintain the support and at least first member in a predetermined operative relationship, the one member of each of the support and at least first member each having a length aligned to be substantially parallel with a length of the support and at least first member, the support and at least first member maintained in the predetermined operative relationship without requiring that any anchoring element be directed through the maneuvering surface.

25. The extreme sports component according to claim 24 wherein the one member on each of the support and at least first member extend over substantially the entire length of the first member.

26. An extreme sports component comprising:

a support; and at least a first member defining a maneuvering surface and joined operatively to the support, the support and at least first member operatively joined through at least one elongate member on one of the support and at least first member and a slot for receiving the one elongate member on the other of the support and at least first member, the one elongate member engageable within the slot so that the one elongate member is keyed against movement within the slot in directions other than along a first line, the one elongate member and slot having cooperating fixed T-shaped cross-sectional configurations taken transversely to the first line.

* * * * *